US010094608B2

(12) United States Patent
Ouzts

(10) Patent No.: US 10,094,608 B2
(45) Date of Patent: Oct. 9, 2018

(54) BAGLESS EVENT ICE SYSTEM

(71) Applicant: Daniel Ouzts, Elberton, GA (US)

(72) Inventor: Daniel Ouzts, Elberton, GA (US)

( * ) Notice: Subject to any disclaimer, the term of this patent is extended or adjusted under 35 U.S.C. 154(b) by 156 days.

(21) Appl. No.: 14/845,273

(22) Filed: Sep. 4, 2015

(65) Prior Publication Data

US 2017/0067680 A1 Mar. 9, 2017

(51) Int. Cl.

| | |
|---|---|
| ***F25D 3/12*** | (2006.01) |
| ***F25C 5/182*** | (2018.01) |
| ***F25C 5/20*** | (2018.01) |

(52) U.S. Cl.

CPC ..... *F25C 5/182* (2013.01); *F25C 5/24* (2018.01)

(58) Field of Classification Search

CPC .. F25C 5/182; F25C 1/00; F25C 5/007; F25C 5/18

See application file for complete search history.

(56) References Cited

U.S. PATENT DOCUMENTS

| | | | | |
|---|---|---|---|---|
| 3,930,377 | A | 1/1976 | Utter | |
| 5,299,427 | A | 4/1994 | Miller et al. | |
| 5,361,602 | A * | 11/1994 | Furukawa | F25C 5/18 312/111 |
| 6,405,553 | B1 * | 6/2002 | Willett | F25C 1/00 62/298 |
| 6,898,947 | B2 * | 5/2005 | Hebert | A61B 17/322 62/348 |
| 7,954,830 | B2 | 6/2011 | Begin et al. | |
| 2001/0037657 | A1 * | 11/2001 | Dasher | F25C 5/182 62/459 |
| 2006/0005565 | A1 * | 1/2006 | Roth | F25C 5/182 62/344 |

* cited by examiner

*Primary Examiner* — Elizabeth Martin
(74) *Attorney, Agent, or Firm* — Kenneth A. Buffington

(57) ABSTRACT

The bagless event ice system is composed of a housing and a method of shipping and storing large quantities of ice to large events. Since ice bags are not used in the process, the system requires less manpower and no waste disposal issues. The housing is a specialty container on a pallet size format designed to hold and make easily available up to 1500 lbs. of ice at an event. The container serves not only as a shipping container, but an ice dispensing unit as well.

6 Claims, 11 Drawing Sheets

BAGLESS EVENT ICE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Field of the Invention

This invention relates generally to an ice storage bin and more particularly, to an ice storage transportation system for conveying ice between remotely located ice producing machines or plants and end user events requiring massive quantities of ice.

Background of the Invention

From Woodstock to Sturgis, from Talladega to the Rose bowl, America is a place where enormous crowds love to gather at super-sized events to have fun, relax, celebrate, compete and just enjoy life! Most of our country's largest events are held outdoors; in nice weather, resulting in massive amounts of crushed ice being consumed by the participants and attendees. For example, an Indy or NASCAR "race week" in warm weather can require over fifteen tractor trailer loads of crushed ice in order to function, totaling well over a half a million pounds! That's fifty thousand of those 10 lb. ice bags found in a grocery store. Large events always leave mountains of plastic trash in their wake, and much of this consist of thousands and sometimes tens of thousands of plastic ice bags and stretch wrap for disposal.

Along with the massive plastic waste involved, the physical challenge of actually getting this ice where it needs to go within these large venues is daunting. Back injuries account for nearly half of all injuries in the foodservice industry. Ice men or event staff arrive a day or two in advance of the event, and physically manhandle thousands of those 10, 20, and 40 lb. ice bags multiple times, before they finally land in one of the many ice boxes scattered throughout the stadium or grounds. The work is back straining and time consuming, which combined with all of the plastic waste it produces, is a process that has been screaming for innovation for decades.

Ice always ends up in a bucket, a cooler, a tub or some other container at an event. Seldom, if ever does its final use require the ice to be in the bag that it came in. And so every single one of the millions of ice bags that go to our events must be manually lifted, busted and then torn open one by one. Aside from all this unnecessary work, with the environmental issues we now face, millions of throwaway plastic bags are not needed at these events.

Numerous ice storage bins have been provided in the prior art. For example, U.S. Pat. Nos. 5,299,427 to Miller; 7,954,830 to Begin; and 3,930,377 to Utter all are illustrative of such prior art. While these units are designed as ice storage bins, they do not account for the transportation of massive quantities of ice from one location to the other.

Accordingly, a bagless event ice system (BEIST) that allows for the easy transportation of massive quantities of ice from one location to the other with minimal manual labor and environmental waste would be desirable.

SUMMARY OF THE INVENTION

In accordance with the present invention, the bagless event ice system (BEIST) comprises a source of particles of ice; a plurality of ice bin housings, and a method of transporting the ice bin housings to events. The BEIST is an ice handling container, not an ice making machine. The container is maintenance free since there are no moving parts. No refrigeration is required, no there is no environmentally damaging freon or other refrigerant released to the atmosphere. A single ice bin housing can effectively handle ice for any event with less manpower and eliminating waste disposal issues since ice bags are not used in the process. The plastic ice bag serves no purpose other than a temporary disposable container. The BEIST is a specialty container on a pallet size format designed to hold and make easily available up to 1500 lbs. of ice anywhere you place it at an event. Each container is easily transportable and hold ice in pristine condition for several days, even in hot weather, without the use of refrigeration or electricity. Typical dimensions are 4 ft. length, 4 ft. width, and 7 ft. height. Size is important since larger ice shipments require less costs. The BEIST transfers large quantities of crushed ice from the enormous holding bins of ice factories to the consumers cup at large events, no other equipment or methods exist in the prior art. The BEIST serves not only as a shipping container, but an ice dispensing unit as well. It is provided with doors, meltwater tank and ice chutes in addition to other dispensing features. The BEIST may be thought of as a reusable 1500 lb. ice bag. It eliminates all of the repetitive lifting associated with ice bags, reducing worker fatigue and injuries. Since there are no ice bags to break up or bust on the floor, there is no risk of incidental ground contamination. The benefits include the reduction of manual labor, reduction of energy waste, reduction of plastic waste, and reduction of greenhouse emissions.

BRIEF DESCRIPTION OF THE DRAWINGS

Referring now to the drawings in which like reference numbers represent corresponding parts throughout.

DETAILED DESCRIPTION OF THE INVENTION

Figure 1:
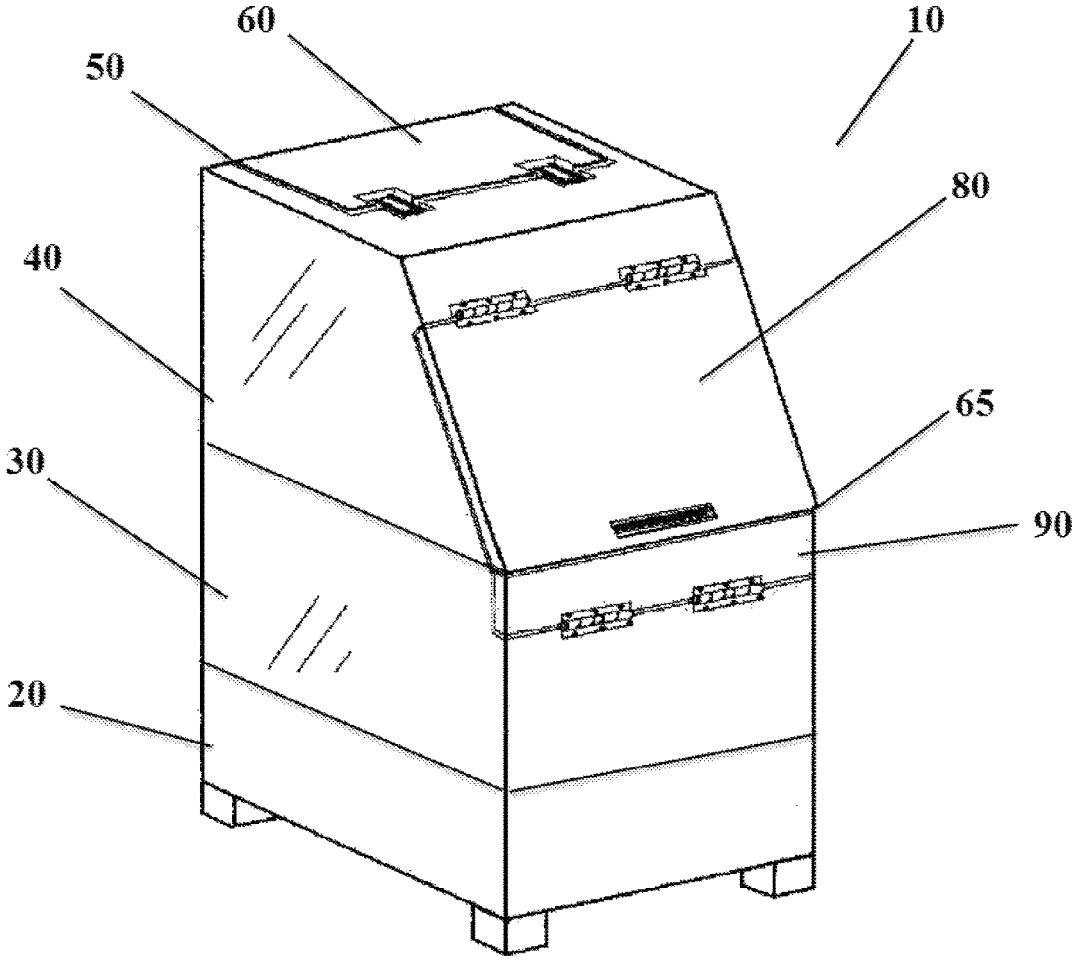
FIG. 1 is a side perspective view of the ice bin housing according to a preferred embodiment of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the drawings, the bagless event ice system (BEIST) is composed of a housing 10 and a method or means of shipping and storing large quantities of ice particles to large events. As shown in FIGS. 1-5, a housing 10 is composed of a base 20, a lower unit 30, and an upper unit 40. The base 20 in the form of a rectangular box opened upward, and a lower unit 30 in the form of a rectangular box mounted on an upper periphery of the base 20 and opened in both upward and downward directions. The upper unit 40 in the form of a somewhat trapezoidal prism opened downward mounted on the upper periphery of the lower unit 30.

Rectangular openings in the housing 10 are formed atop the upper unit 40, and laterally between the upper unit 40 and lower unit 30. The rectangular opening 50 located atop the upper unit 40 is for loading ice into the bin 70, and a rectangular loading door 60 pivoted at its rear end is provided for opening and closing. The rectangular opening 65 formed between the upper 40 and lower 30 units open into the ice bin 70, and is covered by a rectangular front door 80 and a rectangular vendor door 90. The front door 80 is pivoted upwards approximately 180 degrees and maintains that position until closed. The vendor door 90 is located just below the front door 80 and pivots downwards approximately 90 degrees and maintains that position until closed.

Figure 2:
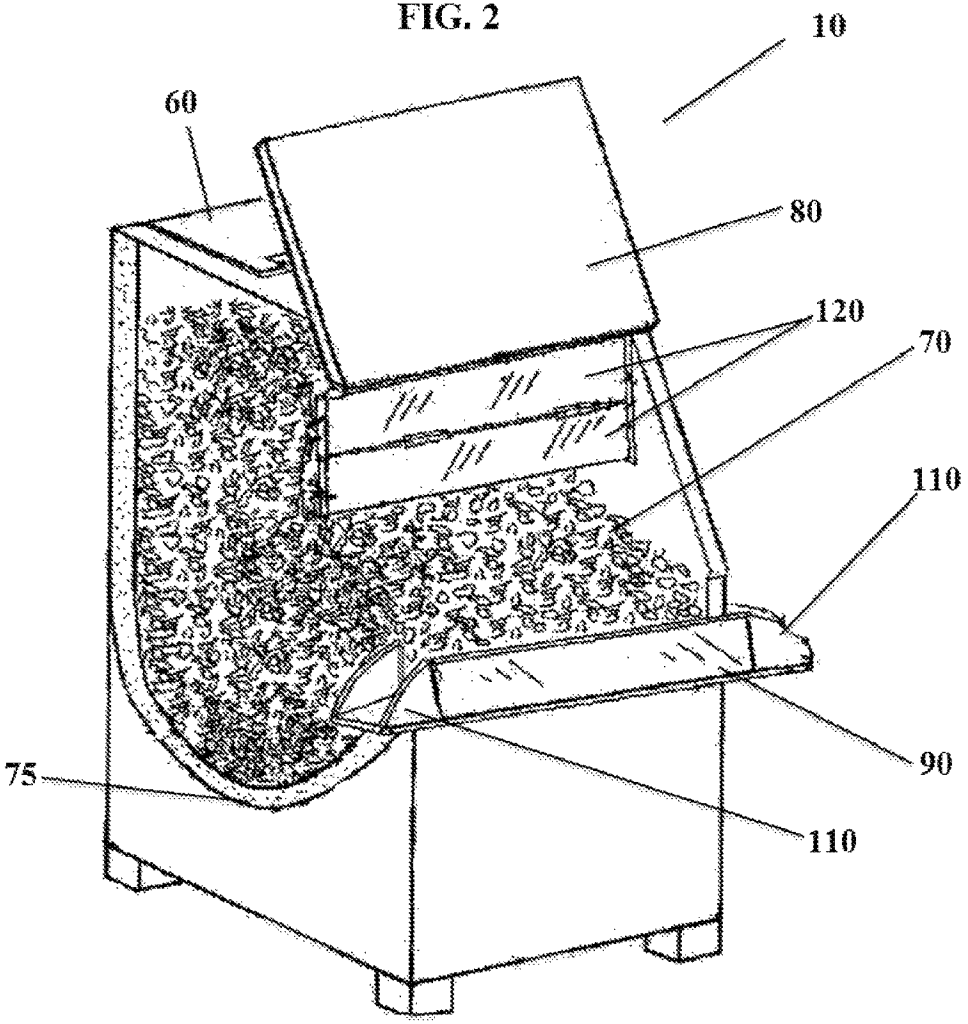
FIG. 2 is a side cross sectional view of the ice bin housing according to a preferred embodiment of the present invention.
Figure 3:
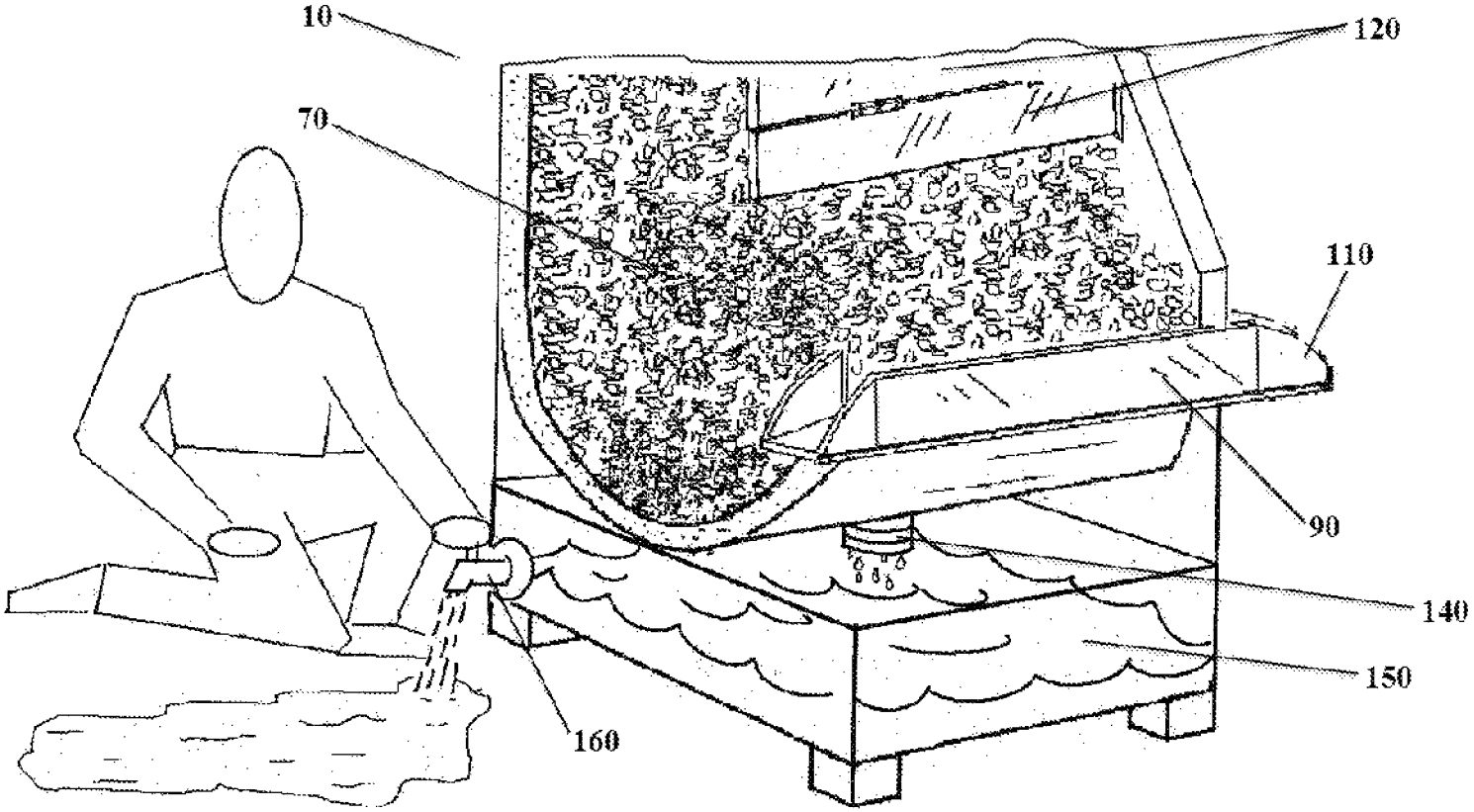
FIG. 3 is a side cross sectional view of the ice bin housing with a drain, drain valve and meltwater tank according to a preferred embodiment of the present invention.
Figure 4:
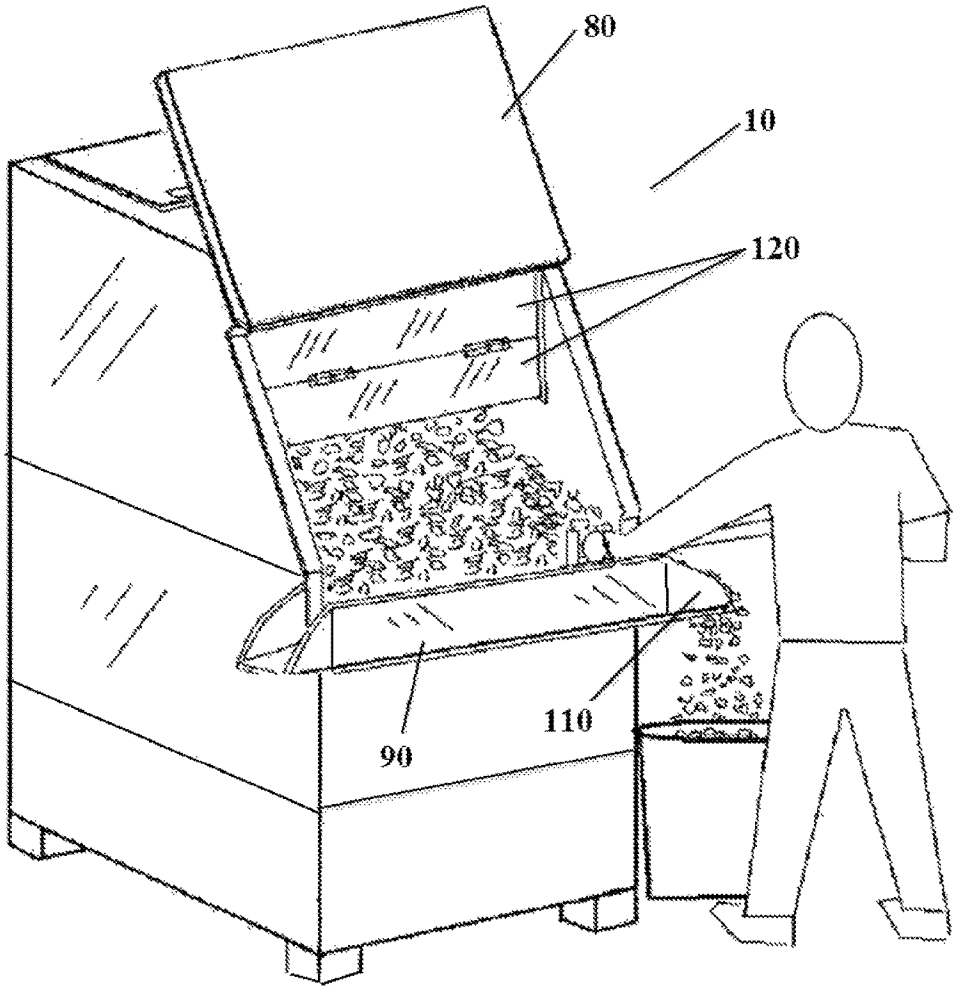
FIG. 4 is a side perspective view of the ice bin housing with the ice chutes in the down position according to a preferred embodiment of the present invention.

As best shown in FIGS. 2-4, the inside portion of the vendor door 90 is provided with a plurality of ice chutes 110 to aid is scraping or dispensing ice out of the ice storage bin 70 and into a consumer container which includes an ice bucket, tray, cup, or the like. Each chute 110 is pivoted open or closed. An ice retaining wall 120 holds and secures the ice inside the bin 70 to control the ice flow so ice bridges can be broken without spilling ice on the floor. The ice retaining wall 120 has three positions: fully up, halfway up, and fully down. Basic ice picks and similar tools are used to break the ice.

As shown in FIGS. 2-3, the bottom 75 of the ice bin 70 is curved to direct the water from the melted ice into the drain 140 which is positioned at the lowest point or bottom 75 of the curved surface. The surface is curved to aid in ice removal, and direct the water from the melted ice into the drain 140 which is positioned at the lowest point of the curved surface. The drain 140 is connected to a meltwater tank 150 in the base 20. The tank 150 is provided with a valve 160 to drain the water outside.

Figure 5:
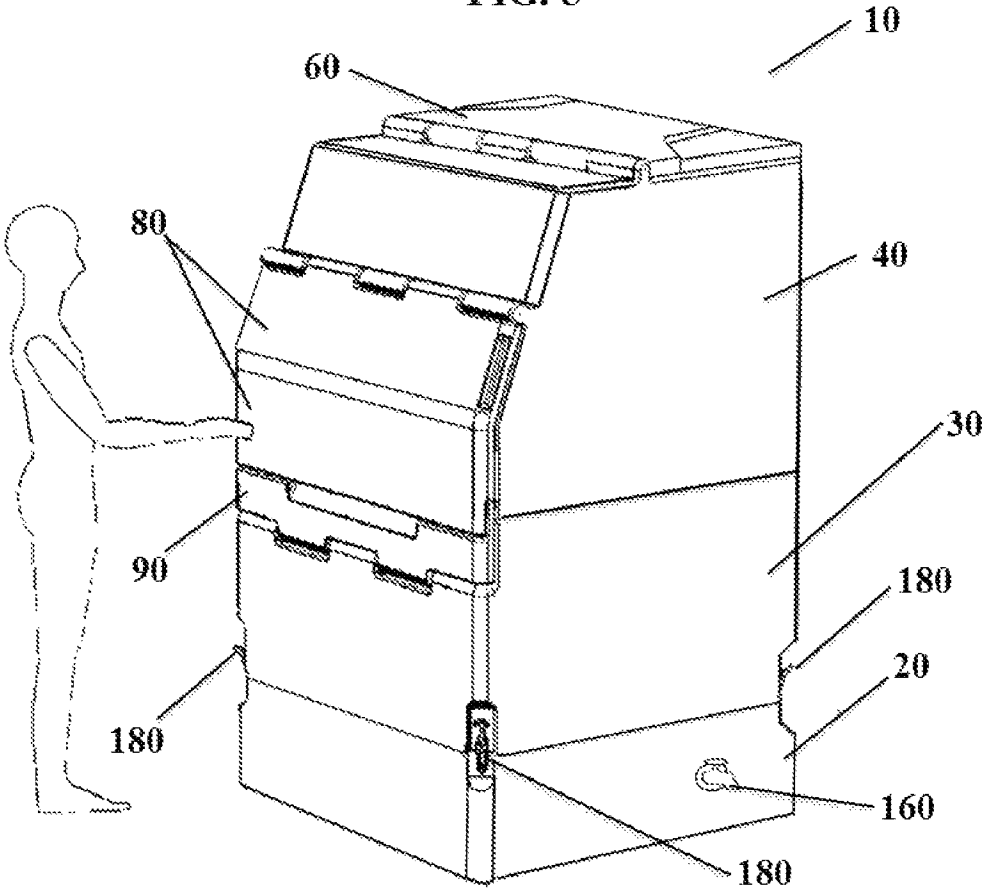
FIG. 5 is a side perspective view of the ice bin housing with fasteners and a drain valve according to a preferred embodiment of the present invention.

As shown in FIG. 5, another embodiment of the invention shows the upper unit 40 and lower unit 30, and then the lower unit 30 detachably fitted over the base 20 unit with fasteners 180 attached to each corner of the base 20. The upper unit 40 and lower unit 30 can be detached from the base unit 20 to clean or service the meltwater tank 150, drain 140, and valve 160.

Figure 6:
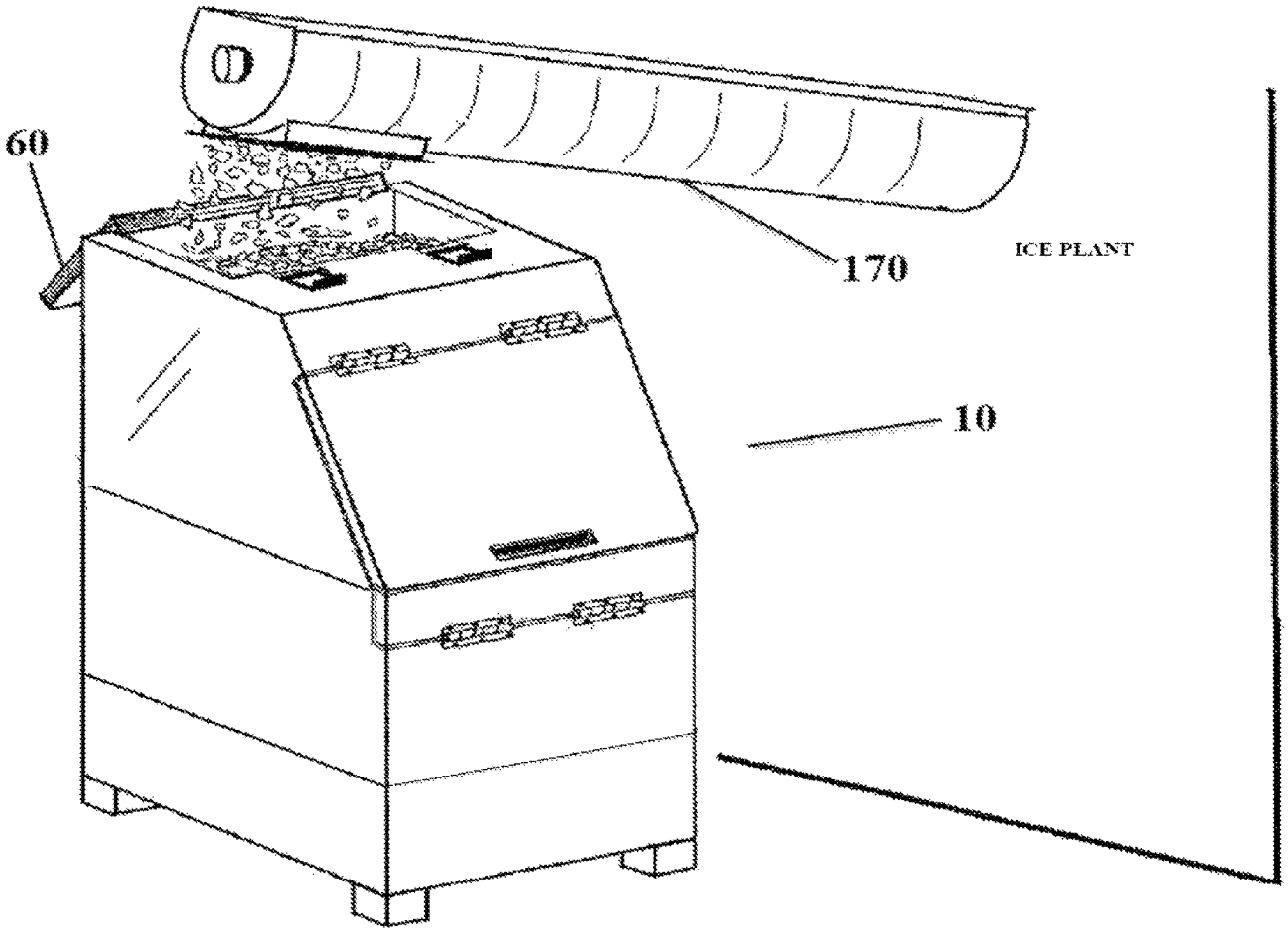
FIG. 6 is a side perspective view of the ice bin housing loaded at the ice source according to a preferred embodiment of the present invention.
Figure 7:
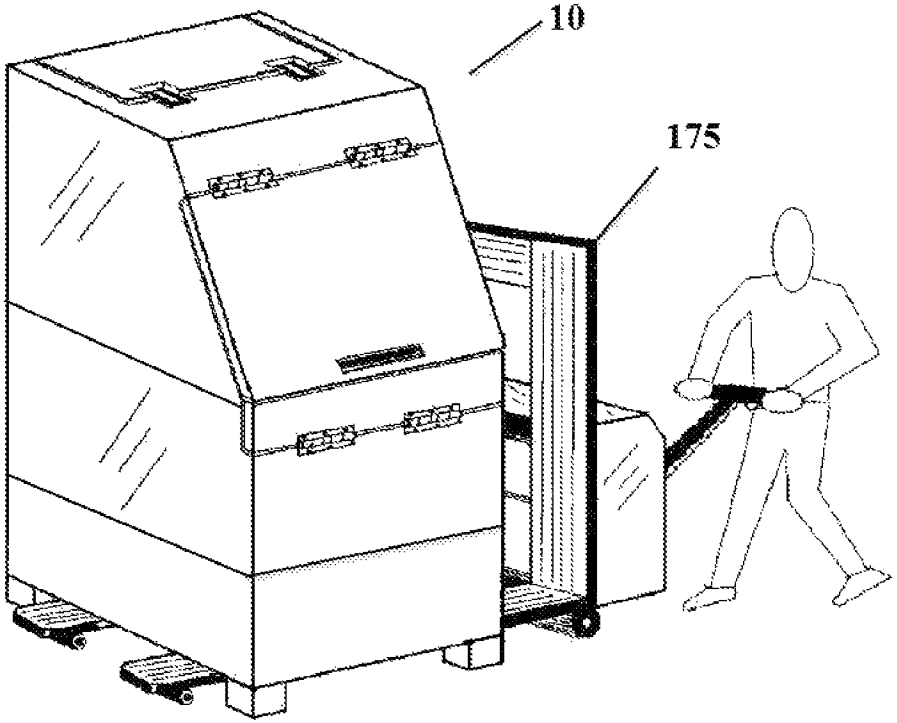
FIG. 7 is a side perspective view of the ice bin housing transported with a portable hand pallet truck according to a preferred embodiment of the present invention.

As shown in FIG. 6, the ice bin 70 is loaded with ice particles at the ice source for transportation to an event, The loading door 60 is open and ice is placed inside the bin 70 by the ice plant's or ice source's loading means 170. As shown in FIG. 7, the loaded ice bin 70 is transported on a pallet truck 175 or other means to a vehicle for final delivery to an event that requires a large quantity of ice.

EXAMPLE

A major college football game requires 160,000 lbs. of crushed ice, Normally, this would require 8,000 of 20 lb. ice bags. Each ice bag is handled or lifted an average of 5 times. Collectively, these bags as collectively lifted an average of 40,000 times. Back injuries account for a significant number of injuries in the foodservice industry. However, the BEIST eliminates all of the repetitive lifting associated with ice bags, reducing worker fatigue and injuries at events. Since repetitive lifting is eliminated, labor costs are reduced too.

Figure 9:
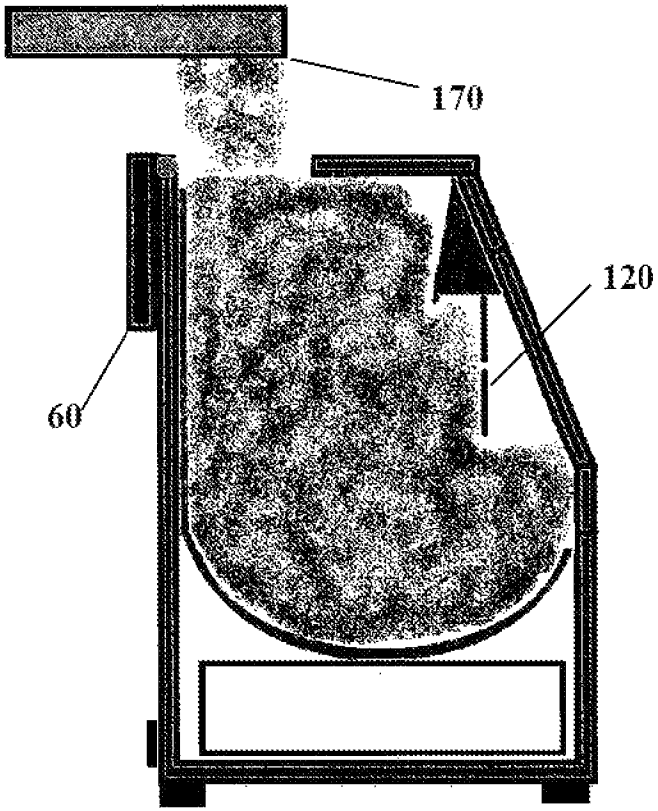
FIG. 9 is an illustrative side view of the ice bin housing filled at an ice source with the ice retaining wall in the fully down position according to a preferred embodiment of the present invention.
Figure 8:
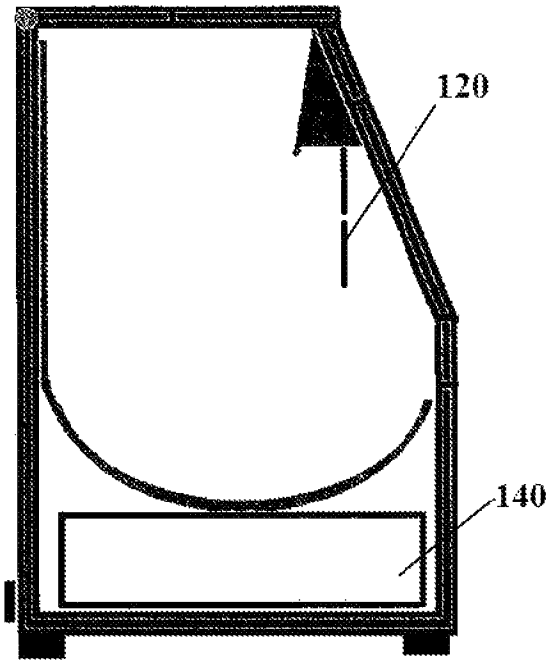
FIG. 8 is an illustrative side view of the empty ice bin housing with the ice retaining wall fully down according to a preferred embodiment of the present invention.
Figure 11:
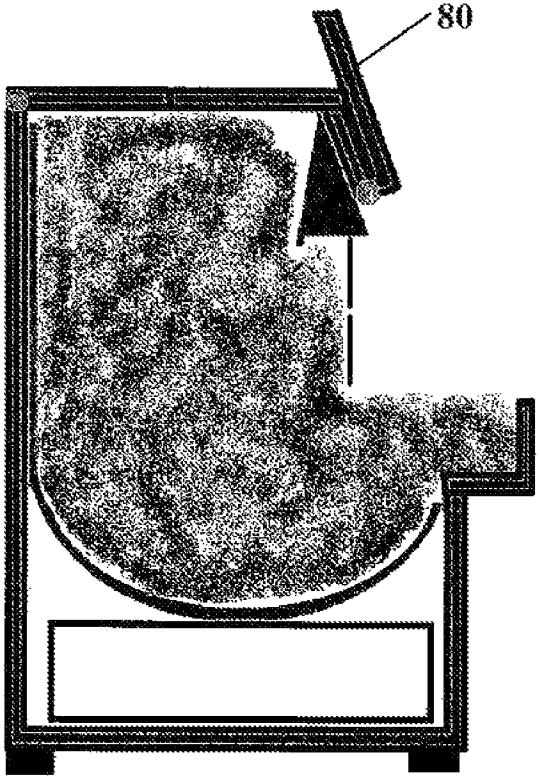
FIG. 11 is an illustrative side view of the full ice bin housing ready for use with the ice retaining wall in the fully down position and front door open according to a preferred embodiment of the present invention.
Figure 10:
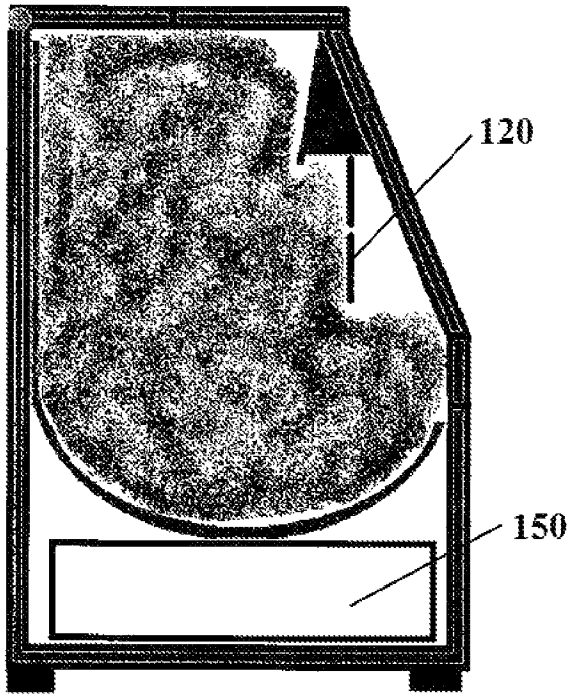
FIG. 10 is an illustrative side view of the full ice bin housing ready for shipment with the ice retaining wall in the fully down position according to a preferred embodiment of the present invention.
Figure 13:
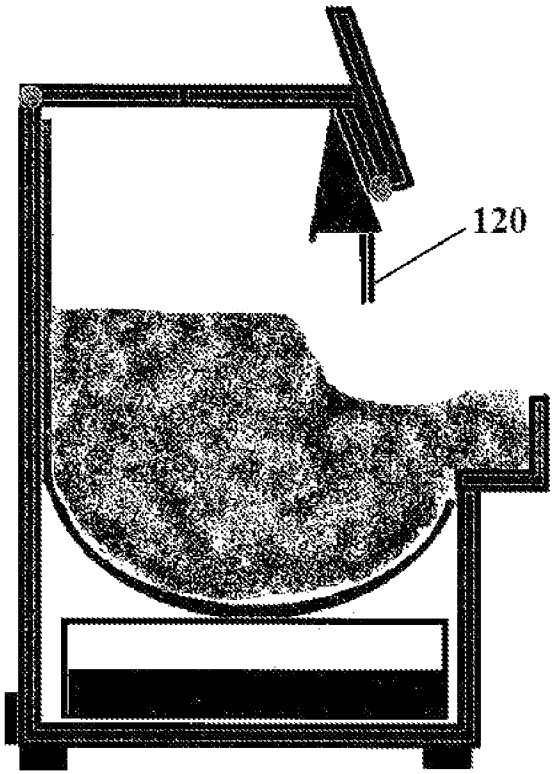
FIG. 13 is an illustrative side view of the partially full ice bin housing with the ice retaining wall halfway down according to a preferred embodiment of the present invention.
Figure 12:
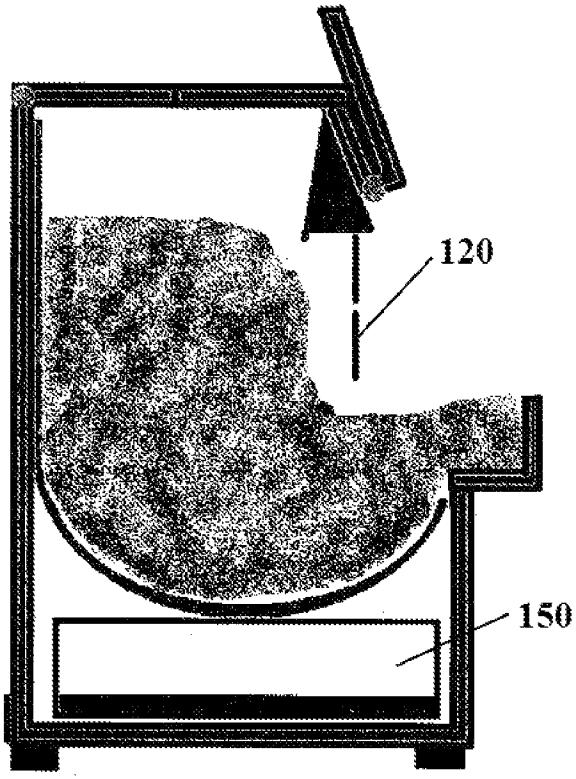
FIG. 12 is an illustrative side view of the partially full ice bin housing with the ice retaining wall fully down according to a preferred embodiment of the present invention.
Figure 15:
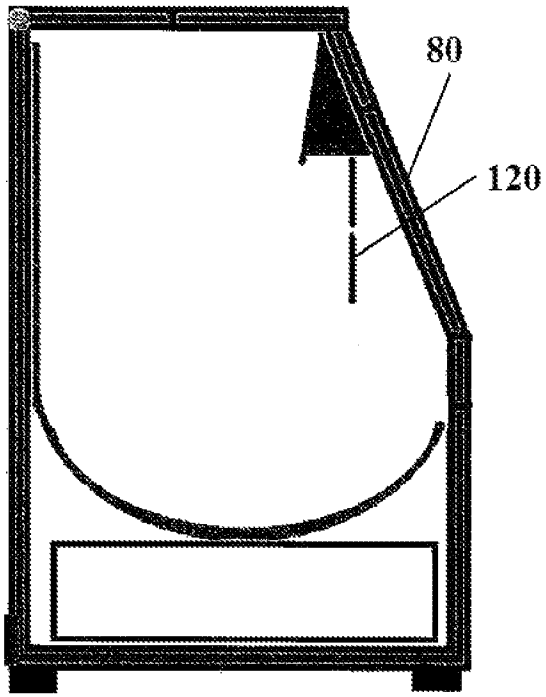
FIG. 15 is an illustrative side view of the empty ice bin housing with the ice retaining wall fully down according to a preferred embodiment of the present invention.
Figure 14:
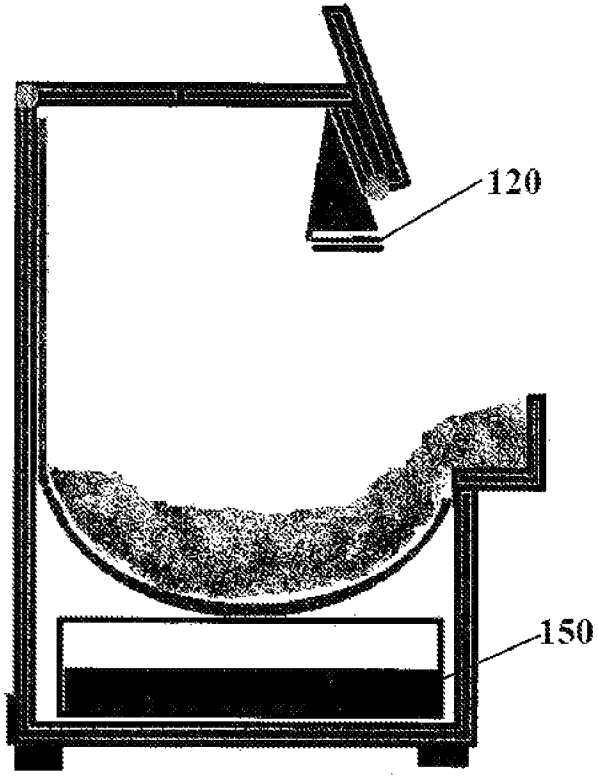
FIG. 14 is an illustrative side view of the partially full ice bin housing with the ice retaining wall fully up according to a preferred embodiment of the present invention.

As shown in FIGS. 8 and 15, operation of the BEIST cycle begins and ends with an empty bin 70 with an empty meltwater tank 140 and retaining wall 120 fully down. As best shown in FIGS. 6 and 9, the loading door 60 is open and the ice plant or source loads a large quantity of ice into the bin 70 by their loading means 170. The ice retaining wall 120 is fully down to hold back ice to permit opening the front door 80 without spilling ice to the outside. In FIG. 10 after the bin 70 is filled with ice, the loading door 60 is closed. As shown in FIG. 7, the bin is transported to a vehicle by a pallet truck 175 or other suitable means. After arrival at the event, the bin 70 is unloaded and placed in position, and the front door 80 and vendor door 90 is open, ice in bulk is taken out using special pick utensils. As best shown in FIG. 4, the ice chutes 110 are placed in the down position. Ice is scrapped into a consumer container. As ice inside the bin diminishes due to removal and melting, the ice retaining wall are raised as needed to access the remaining ice. In FIGS. 3 and 12, the ice removed and begins to melt and begin to fill the meltwater tank 150. In FIG. 13, the ice retaining wall 120 is raised halfway to allow for additional access to the ice. In FIG. 14, as the ice diminishes, the ice retaining wall 120 is raised to the fully up position to allow for removal of the remaining ice. As shown in FIG. 3, the meltwater tank 150 may require draining due to the melted ice. Ice is pulled out until the unit is empty. After the unit is empty, the doors are closed. Shipping containers are picked up and transported back to the ice plant where they are, cleaned, drained, and refilled for next event.

A bagless method of transporting ice particles from a source to a consumer in accordance with the present invention may include some are all of the following steps: (a) providing a housing comprising a base, a lower unit, an upper unit, a plurality of ice chutes, a front door, a vendor door, a retaining wall, a loading door, and a meltwater tank; (b) providing a source of ice particles; (c) positioning the housing in place at the source; (d) opening the housing loading door; (e) placing retaining wall in the fully down position; (f) closing the front door; (g) closing the vendor door; (h) loading ice particles until bin is full; (i) closing the housing loading door; (j) transporting housing to event; (k) opening front door; (l) opening the vendor door; (m) placing the ice chutes in the down position; (n) scrapping ice from the housing into the ice chutes; (o) scraping ice from the ice chutes into a consumer container; (p) placing the retaining wall in the halfway up or fully up position as the ice melts; (q) draining the meltwater tank as it fills with water; and repeating steps (n) through (q) until all the ice is removed from the housing.

Another bagless method of transporting ice particles from an ice source to a large event in accordance with the present invention may include some are all of the following steps: (a) providing a source of ice particles; (b) providing a housing for receiving ice particles; (c) providing a means of transportation from said source to an event; and (d) dispensing the ice from the housing to the consumer; wherein said method reduces manual labor, energy, and environmental waste.

I claim:

1. A bagless event ice system comprising:

a.) a source of ice particles;

b.) at least one housing; each said housing having a base, a lower unit, an upper unit, c.) each said base having a plurality of fasteners attached to each corner of said base for attaching said lower unit to said base;

d.) a vertical retractable folding ice retaining wall with three positions, wherein the ice retaining wall retracts and folds fully up, halfway up, and fully down; and e.) a truck for transporting said housing to a vehicle, wherein said vehicle transports said housing to an event.

2. The bagless event ice system as claimed in claim 1, wherein said base contains a meltwater tank.

3. The bagless event ice system as claimed in claim 1, wherein the entire housing is sufficiently large enough to hold 1,500 pounds of ice particles.

4. The bagless event ice system as claimed in claim 1, wherein said base contains a drain and valve.

5. The bagless event ice system as claimed in claim 1, wherein said housing contains a front door, loading door, and vendor door.

6. The bagless event ice system as claimed in claim 5, wherein said vendor door contains a plurality of ice chutes.

* * * * *